US012049287B1

(12) United States Patent
Donnelly

(10) Patent No.: US 12,049,287 B1
(45) Date of Patent: Jul. 30, 2024

(54) WAKESURFING SYSTEMS AND METHODS

(71) Applicant: Brunswick Corporation, Mettawa, IL (US)

(72) Inventor: Kevin J. Donnelly, Edgewater, FL (US)

(73) Assignee: Brunswick Corporation, Mettawa, IL (US)

( * ) Notice: Subject to any disclaimer, the term of this patent is extended or adjusted under 35 U.S.C. 154(b) by 0 days.

(21) Appl. No.: 18/599,874

(22) Filed: Mar. 8, 2024

Related U.S. Application Data

(63) Continuation of application No. 18/331,657, filed on Jun. 8, 2023.

(51) Int. Cl.

| | |
|---|---|
| ***B63B 34/70*** | (2020.01) |
| ***B63B 79/10*** | (2020.01) |
| ***B63B 79/40*** | (2020.01) |
| ***B63H 20/10*** | (2006.01) |
| ***B63H 25/38*** | (2006.01) |
| *B63H 20/00* | (2006.01) |

(52) U.S. Cl.
CPC ..... *B63B 34/70* (2020.02); *B63B 79/10* (2020.01); *B63B 79/40* (2020.01); *B63H 20/10* (2013.01); *B63H 25/38* (2013.01); *B63H 2020/003* (2013.01)

(58) Field of Classification Search
CPC ..... B63B 34/70
See application file for complete search history.

(56) References Cited

U.S. PATENT DOCUMENTS

| | | | | |
|---|---|---|---|---|
| 6,138,601 | A | 10/2000 | Anderson et al. | |
| 8,539,897 | B1 * | 9/2013 | Gasper | B63B 34/75 114/284 |
| 8,833,286 | B1 * | 9/2014 | Sheedy | B63B 34/75 114/285 |
| 9,315,235 | B1 * | 4/2016 | Wood | B63B 39/061 |
| 10,040,522 | B1 | 8/2018 | Hartman et al. | |
| 11,254,402 | B1 | 2/2022 | Poirier et al. | |
| 11,260,946 | B1 | 3/2022 | Przybyl et al. | |
| 2013/0228114 | A1 * | 9/2013 | Gasper | B63B 1/32 114/284 |
| 2014/0261135 | A1 * | 9/2014 | Gasper | B63B 13/00 114/284 |
| 2017/0029072 | A1 * | 2/2017 | Gasper | G08B 21/084 |
| 2017/0038771 | A1 * | 2/2017 | Green | G05D 1/0033 |
| 2017/0349247 | A1 * | 12/2017 | Herrington | B63H 21/32 |
| 2022/0075363 | A1 * | 3/2022 | Green | G06F 3/165 |
| 2022/0089258 | A1 * | 3/2022 | Uggeri | B63B 34/70 |

(Continued)

FOREIGN PATENT DOCUMENTS

| | | | | |
|---|---|---|---|---|
| AU | 2013205024 B2 * | 11/2016 | | B63B 1/32 |
| CN | 217805210 U * | 11/2022 | | |
| WO | WO-2013040576 A1 * | 3/2013 | | B63B 1/32 |

*Primary Examiner* — Shelley Chen
(74) *Attorney, Agent, or Firm* — Andrus Intellectual Property Law, LLP

(57) ABSTRACT

A surf control system for a marine vessel includes at least a first steerable device on a first side of the marine vessel and second steerable device on a second side of the marine vessel. A control system is configured to steer the first steerable device to a first steering angle to generate an asymmetric surfable wave behind the marine vessel and control the second steerable device on a second side of the marine vessel based on a steering command input.

27 Claims, 9 Drawing Sheets

(56) References Cited

U.S. PATENT DOCUMENTS

| | | | | |
|---|---|---|---|---|
| 2023/0294799 | A1* | 9/2023 | Kalil | B63H 25/38<br>114/284 |
| 2024/0101227 | A1* | 3/2024 | Dickinson | B63H 25/02 |
| 2024/0132184 | A1* | 4/2024 | Ritter | B63H 11/04 |

* cited by examiner

WAKESURFING SYSTEMS AND METHODS

CROSS REFERENCE TO RELATED APPLICATION

This application is a continuation of U.S. patent application Ser. No. 18/331,657, filed Jun. 8, 2023, the contents of which is hereby incorporated by reference in its entirety.

FIELD

The present disclosure relates to marine vessels, and more particularly to systems and methods for creating a surfable wave as generated by a steerable marine device.

BACKGROUND

The following U.S. Patents are incorporated herein by reference, in entirety:

U.S. Pat. No. 11,254,402 discloses a method of controlling propulsion for automated launch control that includes receiving a user-selected command associated with wake surfing, accessing a predetermined RPM limit associated with the user-selected command, and automatically increasing rotational speed of a powerhead to accelerate the marine vessel to a vessel speed setpoint such that the rotational speed does not exceed the predetermined RPM limit. Once the marine vessel is traveling at the vessel speed setpoint, a cruising RPM value associated with the vessel speed setpoint is identified. A difference between the predetermined RPM limit and the cruising RPM value is determined, and then the predetermined RPM limit is adjusted to an adapted RPM limit based on the difference. The adapted RPM limit is then stored for use during a subsequent launch.

U.S. Pat. No. 11,260,946 discloses a method of automatically controlling trim position of a marine drive with a control system on a marine vessel that includes receiving a user-selected command associated with wake surfing and then controlling a trim actuator to automatically position the marine drive in a tucked position, tucked position is between a vertical trim position and a minimum running trim position. Once a vessel condition of the marine vessel reaches a first threshold vessel condition the trim actuator is controlled to trim up the marine drive to a predetermined target trim position to generate wave behind the marine vessel. The first threshold vessel condition is at least one of a threshold vessel speed, a threshold engine speed, a threshold engine load, and a threshold vessel pitch.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In one aspect of the present disclosure, a surf control system for a marine vessel includes at least a first steerable device on a first side of the marine vessel and a second steerable device on a second side of the marine vessel. A control system is configured to steer the first steerable device to a first steering angle to generate an asymmetric surfable wave, control the second steerable device on a second side of the marine vessel based on a steering command input, and control propulsion output on the marine vessel based on a thrust command input.

In one embodiment, the steerable devices consist of two steerable marine drives. The first steerable marine drive is the first steerable device and remains at an outward angle, which may be a fixed angle, and may generate thrust or operate without thrust.

In another embodiment, the system further includes a trim actuator connected to each marine drive and configured to rotate at least one of the steerable devices with respect to a horizontal trim axis, wherein the resulting marine vessel attitude further contributes to the surfable wave.

In one embodiment, one of the steerable devices is a steerable rudder, wherein the steering position of the steerable rudder remains fixed. The second steerable device directs the heading and based on the steering command input.

In another embodiment, the steering command input and the thrust command input are received from input at the helm of the marine vessel. Inputs from the helm may include a steering wheel, throttle lever, joystick, keypad, touchscreen, or trim control buttons, as a non-limiting list of examples.

In another aspect of the present disclosure, a surf control system for a marine vessel includes at least two steerable marine drives and a control system configured set a fixed steering angle for a first steerable marine drive on a first side of the marine vessel and to control a second steerable marine drive based on a user-inputted steering position to control a heading of the marine vessel. The second steerable marine drive is also controlled to effectuate a thrust output based on a thrust command input.

In another aspect of the present disclosure, a method of controlling propulsion of a marine vessel with at least two steerable devices for generating an asymmetric surfable wave behind the marine vessel, includes steering a first steerable device on the marine vessel to a first outward steering angle to generate the asymmetric surfable wave and controlling a second steerable device on the marine vessel based on a steering command input. Propulsion output is controlled based on a thrust command input.

In one embodiment, the first steerable device is a first steerable marine drive on a first side of the marine vessel and the second steerable device is a second steerable marine drive on a second side of the marine vessel. The first steerable marine drive is controlled so as not to produce a propulsion force, and a steering position of the second steerable marine drive is controlled based on the steering command input and a thrust output of the second steerable marine drive is controlled based on the thrust command input.

In another aspect of the present disclosure, a method of generating a surfable wave includes controlling a first steerable device on a first side of the marine vessel to a fixed steering angle and a second steerable device is on a second side of the marine vessel based on a steering command input, and using a trim tab system, wherein the trim tab on the side of the first steerable device creates a roll moment that balances the yaw moment created by the fixed steering angle of the first steerable device, thereby forcing the prop wash over the centerline behind the marine vessel and creating a surfable wave behind the marine vessel.

Various other features, objects, and advantages of the invention will be made apparent from the following description taken together with the drawings.

BRIEF DESCRIPTION OF THE DRAWINGS

The accompanying drawings that are incorporated in and constitute a part of this specification illustrate several embodiments of the disclosure and, together with the description, serve to explain the principles of the disclosure. The present disclosure is described with reference to the following figures.

DETAILED DESCRIPTION

The inventor has recognized that currently available marine vessels configured for producing a wakesurf wave, and thus offering wakesurf capabilities, are typically smaller single drive configurations. Because these marine vessels are small, they often require ballast and/or a surf-specific appendage to increase water displacement by the vessel hull and thereby create a surfable wave. The inventor has developed a surf control system for a multi-drive marine vessel. The inventor has recognized that a multi-drive system can be adapted for surfing and may simplify or eliminate the need for ballast and/or surf-specific appendages. The disclosed system and method allow for surf capabilities on a larger variety of marine vessels without the need for alteration or surf-specific appendages.

On many marine vessels with surf capabilities, a marine drive is responsible for creating a yaw moment that is supplemented by a roll moment created by the extension of a trim tab or a surf-specific appendage. The net effect of these opposing moments creates a delta between the heading and the course direction. The delta creates an asymmetric line behind the marine vessel that carries the displaced water over the centerline and forms an asymmetric surfable wave. Through experimentation, research, and experience in the relevant field, the inventor has recognized that the same or similar surfable wave can also be created with a multi-drive or multi-rudder propulsion system, where one steerable device is steered to an outward angle to create a rudder that pushes water outward while the other steerable device is steered to counteract the yaw and/or roll moment created by the first steerable device. For example, the first and second steerable devices may be a marine drive or a rudder. The first steerable device may be turned to a fixed steering angle while the other is controlled to counteract the yaw moment from the first device, and is also controlled based on a user's steering input to control heading of the marine vessel. Additionally, where the propulsion system includes trim tabs (which are ordinary trim tabs and do not need to be surf-specific appendages), the trim tabs may be utilized to further control the shape and size of the surfable wave. For example, the trim tab on the same side of the marine vessel as the first steerable device may be utilized to create a roll moment that works in conjunction with the yaw moment generated by the first steerable device to create the surfable wave. The combination of these two components forms the same surfable wave and allows a second steerable device, such as a second marine drive, to steer and provide thrust to the marine vessel.

Figure 1:
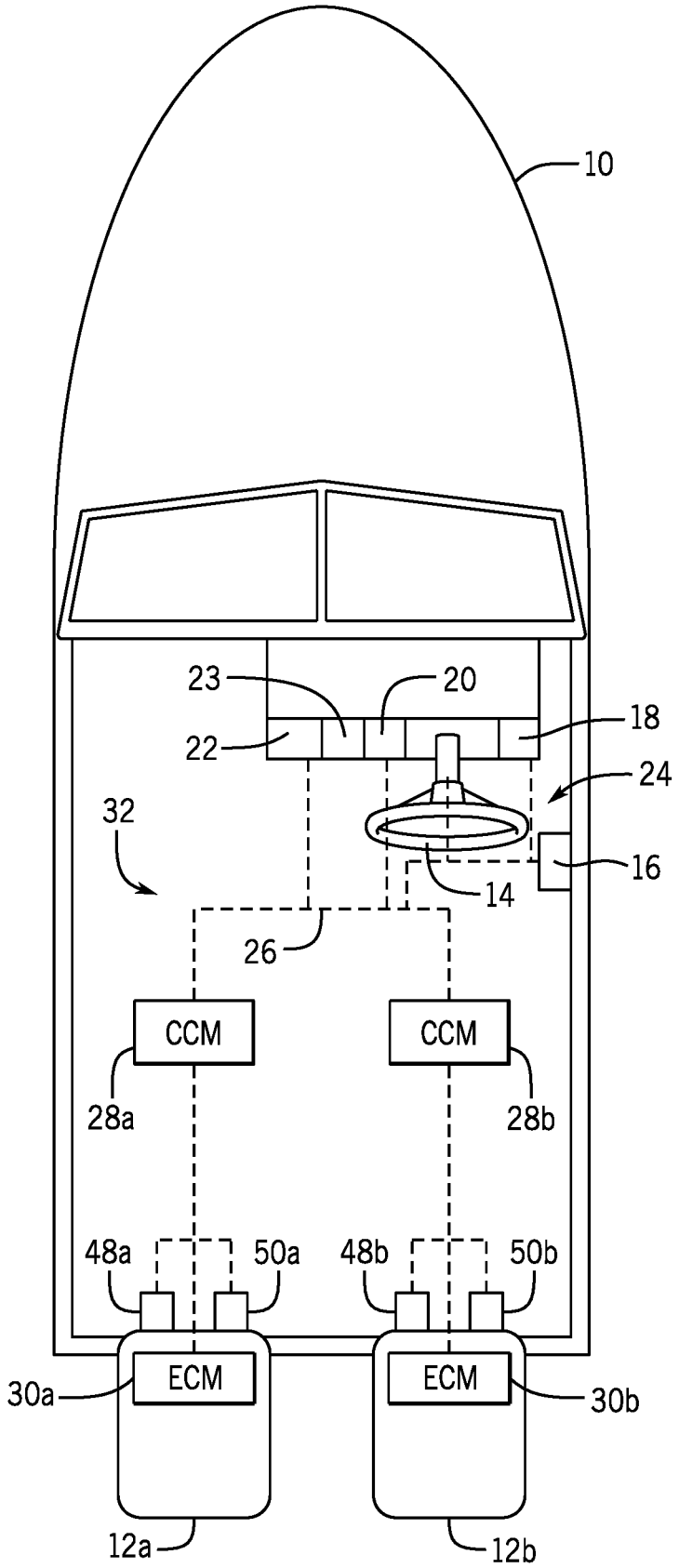
FIG. 1 is a schematic depiction of a marine vessel having a plurality of steerable marine drives and user input devices in accordance with the present disclosure.

FIG. 1 schematically depicts a marine vessel 10 having a plurality of steerable marine drives 12*a*, 12*b*. In the example, the marine drives 12*a*, 12*b* are port and starboard steerable marine drives and are shown coupled to the stern of the marine vessel 10. In other embodiments, the marine vessel 10 may be configured with more than two drives, such as multi-drive systems with three, four, five, or six drives. The marine drives 12*a*, 12*b* shown are outboard drives fixed to the transom, but could alternatively be stern drives, inboard drives, jet drives, straight drives, or any type of marine drive. Similarly, the marine drives may be a forward-facing drive arrangement with the propeller in the front of the drive or may be a more traditional rear-facing drive arrangement. The marine drive(s) may be steerable or may be one or more fixed drives accompanied by at least two steerable rudders. Where the drives are steerable drives, the entire drive housing may be steerable (such as an outboard where the entire drive is steered), or a portion of the drive may be steered (such as in a steerable stern drive or stern drive or outboard with a steerable gearcase). Each marine drive includes a powerhead, such as an internal combustion engine or an electric motor, configured to drive rotation of a propulsor, such as a propeller or an impeller, to effectuate propulsion and move the marine vessel. The effectuated propulsion may be forward or backward propulsion to move the vessel forward or backward or at a range of turn angles. In one embodiment, at least one steerable marine drive may be positioned at a fixed steering angle and provide little or no thrust to the marine vessel.

The marine vessel 10 further comprises at least one user input device for user control input of steering and/or thrust. In the example shown, the user input devices include a steering wheel 14, throttle lever 16, joystick 18, keypad 20, touchscreen 22, and/or trim control buttons 23. The trim control buttons 23 may be a keypad, lever, or any other arrangement configured to facilitate user input to control trim position of the steerable marine drives 12 and/or trim tabs 40 (FIGS. 4A-4B and discussed below) In other embodiments, the keypad 20 and/or touchscreen 22 may be configured as user input devices for inputting a steering command input and a thrust command input for one or more of the steerable marine drives 12. Each of these user input devices may be located at a helm 24 of the marine vessel 10.

The steerable marine drives 12*a-b* may each be separately steerable and trimmable, wherein the trim positions and/or steering positions of each drive are individually controlled. In one embodiment, at least one of the steerable marine drives 12*a*, 12*b* provides little or no thrust and instead performs as a steerable rudder while the remaining drive(s) is used to generate thrust and is steered to propel the vessel at the speed and direction commanded by the user or by an autonomous propulsion control system. The optimal steering angle and trim position for wave generation may differ with each propulsion configuration, each marine vessel, and/or may vary with vessel conditions (such as total weight and weight distribution). For example, in a system with two steerable marine drives 12*a*, 12*b* on a first marine vessel, generating the optimal surfable wave may require a seven degree fixed angle with a fully tucked trim configuration for the drive generating the wave, while a two steerable marine drive 12*a*, 12*b* system on a second marine vessel may perform optimally with a five degree rudder angle and 30% drive trim out position for the fixed steering position.

For marine vessels 10 with three or more steerable marine drives 12, two or more of the steerable drives may be utilized for wave generation and the remaining drive or drives may be utilized for steering and propulsion. In some embodiments with three or more drives, a majority of the marine drives 12 may be used to create the surfable wave with a minority of the marine drives 12 providing steering and thrust to the marine vessel 10. In other embodiments with three or more drives, a majority of the marine drives 12 may be used to create thrust and control steering, while a minority of drives are utilized to generate the surfable wave. The predetermined steering angle of two or more drives participating in wave generation may be calculated separately by the control system 32, where each drive used for wave generation is steered to and held at a different steering angle. The allocation of different steering angles for each steerable marine drive 12 used for wave generation may improve the quality of the created surfable wave behind the marine vessel 10.

A permitted steering range is set for each steerable marine drive (or other steerable device) depending on the propulsion system configuration, such as how closely the drives are placed together on the transom, the size of the drive housings, and the configuration of the steering system and the drive mounts. In some embodiments, the permitted steering range may also be set and selected based on vessel conditions, such as vessel speed, or propulsion control mode. The permitted steering range sets a maximum steering position for a steerable device in each steering direction (clockwise and counterclockwise). In various embodiments, the maximum steering position may be equal in both steering directions, or different limits may be set for each steering direction.

Each of the user input devices 14, 16, 18, 20, 22 is communicatively connected via at least one communication link, such as a controller area network (CAN) bus 26, to one or more controllers, such as command control modules (CCMs) 28*a*, 28*b*. The CCMs 28*a*, 28*b* effectively receive and send all signals from and to the user input devices at the helm 24. In the depicted examples, the CCMs 28*a*, 28*b* are communicatively connected via the communication link 26 to drive control modules, e.g., engine control modules (ECMs) 30*a*, 30*b*, on each steerable marine drive 12. Also note that the controllers 30*a*, 30*b* may take different forms depending on the drive type and powerhead configuration, such as based on whether the drives include one or more engines, motors, or comprise a hybrid arrangement. This control system 32 arrangement is merely representative and various other arrangements are known and within the scope of the disclosure. For example, each drive may comprise two or more controllers, such as a powertrain control module (PCM) and a thrust vector module (TVM), as is well-known in the art. In alternative control system 32 arrangements, a central control module may be provided in addition to or in place of the CCMs 28*a*, 28*b*.

A drive positioning system 9 for positioning steerable marine drives 12*a* and 12*b* includes a trim actuator 48*a*, 48*b* and a steering actuator 50*a*, 50*b* associated with each drive 12*a*, 12*b*. In the depicted example, each CCM 28*a* and 28*b* is communicatively connected (e.g., via a CAN bus arrangement or other communication link) and configured to control the trim actuators 48 and steering actuators 50; however, various other control arrangements are known in the relevant art and within the scope of the present disclosure. The trim actuators 48*a*, 48*b* move the steerable marine drives 12*a*, 12*b* to a requested trim position, in response to signals sent from the CCMs 28*a*, 28*b*, such as based on input from the user input devices (e.g., trim control buttons 23). Further, the control system 32 comprises trim angle sensors 35*a*, 35*b* for sensing current trim positions of the steerable marine drives 12*a*, 12*b* and providing this data to the control modules via the communication link 26. The steering actuators 50*a*, 50*b* are likewise controlled to steer the steerable marine drives 12*a*, 12*b* in response to signals sent from the CCMs 28*a*, 28*b* via the communication link 26. Control of the steering actuators 50*a* and 50*b* may further be based on steering position sensed by the steering position sensors 55*a* and 55*b* configured to sense and actual steering position of the steerable drive portion.

Figure 2:
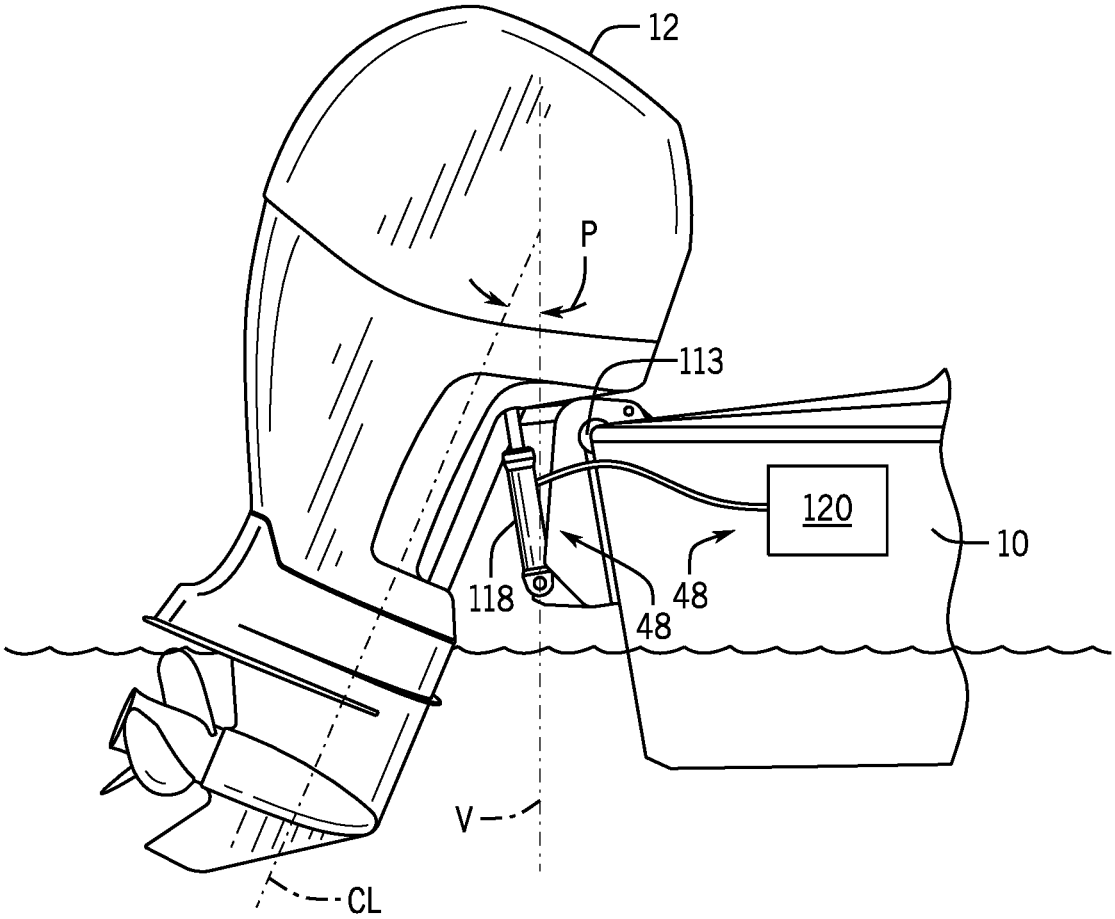
FIG. 2 depicts one embodiment of a trimmable propulsion device according to the present disclosure.

Referring to FIG. 2, the position of a trimmable marine drive 12 (such as the outboard motor shown herein) with respect to the transom of the marine vessel 10 is controlled by a trim system comprising a trim actuator 48, which here is a hydraulic trim actuator. This embodiment of trim actuator 48 includes a hydraulic piston-cylinder assembly 118 connected to a hydraulic pump-motor combination 120. The piston-cylinder assembly 118 has a first end (here, the cylinder end) coupled to the transom of the vessel 10 and a second, opposite end (here, the rod end) coupled to the steerable marine drive 12, as known to those having ordinary rotate the steerable marine drive 12 about a horizontal trim axis 113 to a trimmed-out position, to a trimmed-in position, or to maintain the steerable marine drive 12 in any position therebetween as the pump-motor combination 120 provides skill in the art. The piston-cylinder assembly 118 operates to hydraulic fluid to the piston-cylinder assembly 118 to move the piston within the cylinder. As mentioned, however, other types of hydro-mechanical or electro-mechanical actuators could be used in other examples, including all-electric trim actuation systems.

The pump-motor combination 120 includes a pump-motor connected to a trim-in relay and a trim-out relay. In other examples, the trim-in relay and the trim-out relay are a single relay that can turn the pump-motor on or off and can effectuate a trim-in or trim-out movement of the trim actuator 48. As long as the trim-in relay is activated, the pump-motor provides hydraulic fluid through the first hydraulic line to a first chamber of the piston-cylinder assembly 118, thereby pushing the piston downwardly within the cylinder and lowering (trimming in, or trimming down) the steerable marine drive 12. As long as the trim-out relay is activated, the pump-motor provides hydraulic fluid through the second hydraulic line to the second chamber of the piston-cylinder assembly 118, thereby pushing the piston upwardly within the cylinder and raising (trimming out, or trimming up) the steerable marine drive 12. In this way, the trim actuator 48 can position the steerable marine drive 12 at different angles with respect to the transom. These may be neutral trim position, in which the steerable marine drive 12 is in more or less of a vertical position; a trimmed in (trimmed down) position; or a trimmed out (trimmed up) position. This trim position may position the transom in a position that is optimal for the creation of a surfable wave. For example, to achieve a larger surfable wave, the steerable marine drive 12 may be trimmed to place the transom deeper in the water.

A trimmed out position, as shown in FIG. 2, is often used when the marine vessel 10 is on plane and high speeds are required, or during surfing activities where having the stern of the vessel deeper in the water is beneficial for generating a surfable wave. The trimmed out position causes the bow of the marine vessel 10 to rise out of the water. At high speeds, this results in better handling and increased fuel efficiency. At lower speeds, such as in the wake surfing speed range between 8 and 16 mph, this lowers the position of the stern and increases the water displacement. An auto-trim algorithm may be utilized to control trim of one or more of the marine drives 12*a*, 12*b* to a target running trim position for optimized wave generation based on speed or other vessel conditions, such as but not limited to vessel pitch and/or roll, drive speed, vessel speed, a combination of vessel speed and drive speed, or a tradeoff between vessel speed and drive speed depending on additional vessel conditions. The control system 32 may define the running trim position by reference to a vertical line V. When the centerline CL of the steerable marine drive 12 is parallel to the vertical line V, the control system 32 may consider this to be a vertical trim position, sometimes referred to as zero trim. Trim position can be quantified as a value P with respect to the vertical line V, which represents the angle or comparative position between the centerline CL of the steerable marine drive 12 and the vertical line V. This value P can be expressed as an angle, a percentage of a total angle to which the steerable marine drive 12 can be trimmed, a scalar value, a polar coordinate, or any other appropriate unit.

Figure 3:
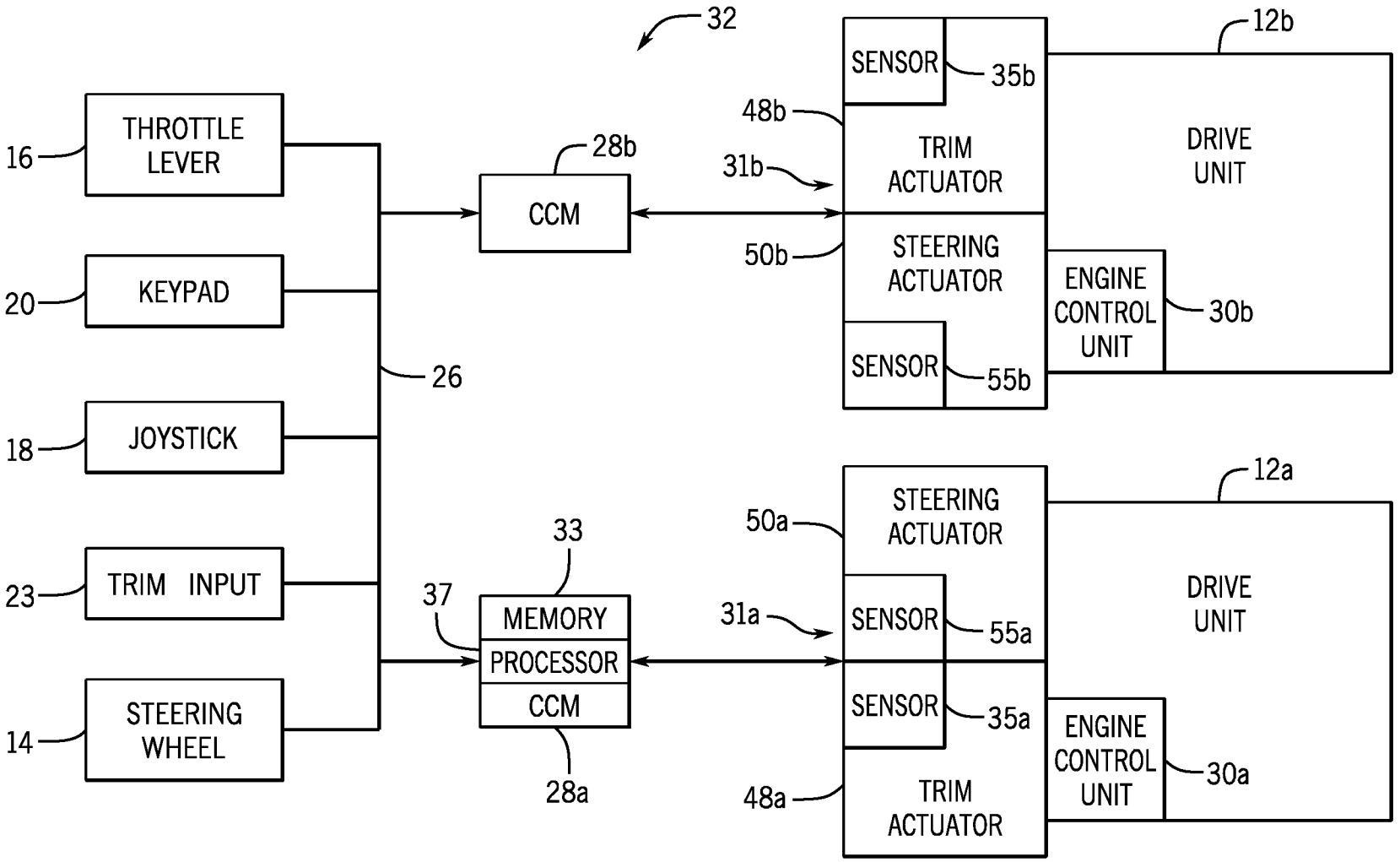
FIG. 3 is a schematic representation of a control system that can be used to position the steerable devices in accordance with the present disclosure.

FIG. 3 depicts a schematic representation of a control system 32 that can be used to control the steerable marine drives 12*a*, 12*b* on the marine vessel 10. The control system 32 may receive input from a throttle lever 16, joystick 18, keypad 20, trim input devices 23 (e.g., trim control buttons), and steering wheel 14 (collectively, the user input devices) connected via communication link 26 to CCMs 28*a*, 28*b*. It should be understood by those having skill in the art that a CAN bus or other physical communication link 26 need not be provided, and that these devices could instead be wirelessly connected (or connected by a different communication link 26) to one another and/or to the CCMs 28*a*, 28*b*. Further, the connections shown in both FIGS. 1 and 3 are for exemplary purposes only and may be arranged to provide different or additional connections between control devices than as shown herein.

Figure 4A:
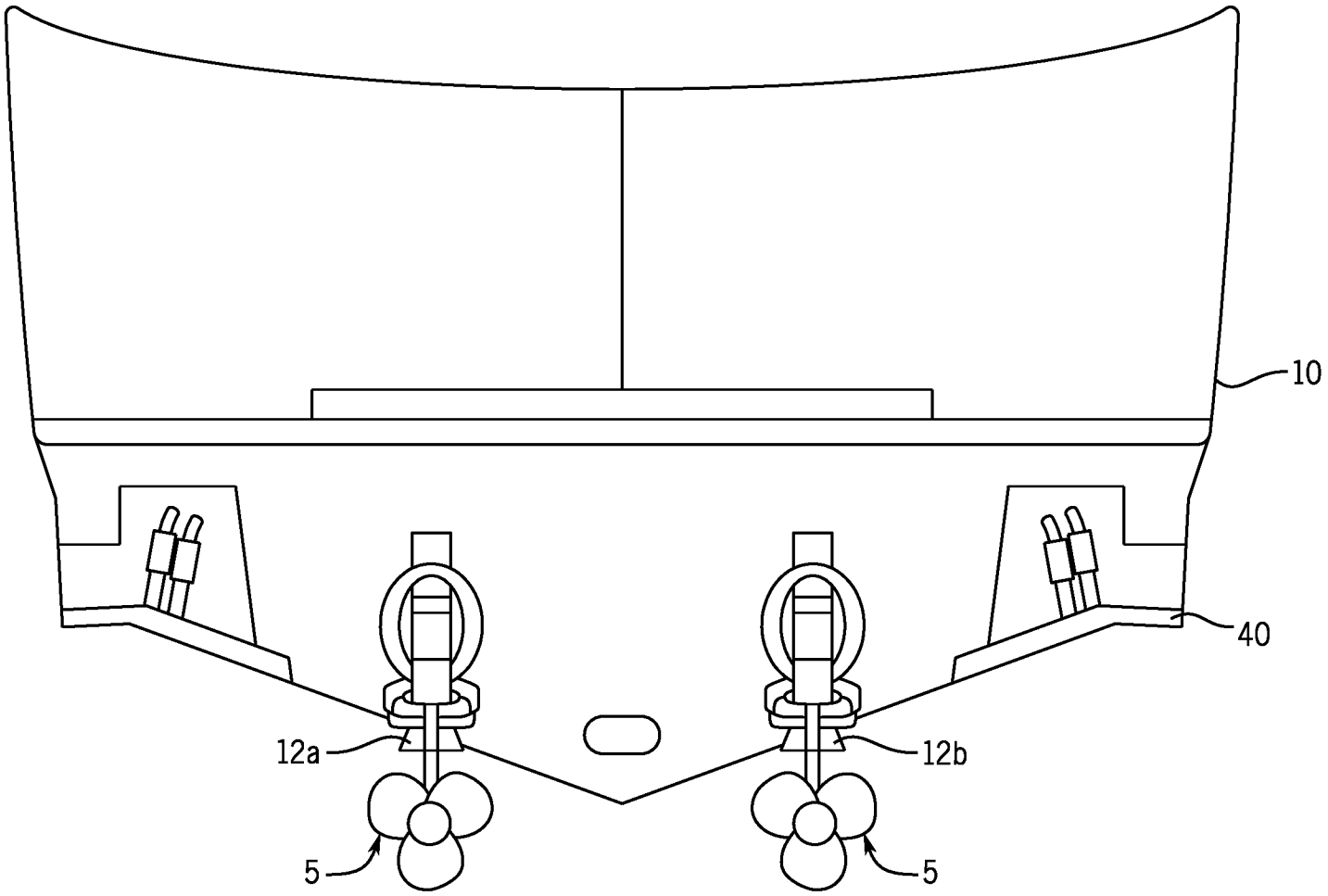
FIGS. 4A-4B and 5 depict embodiments of exemplary surf control systems in accordance with the present disclosure.

In the depicted arrangement, signals from each of the user input devices 14, 16, 20, 23 are sent via the communication link 26 to helm controller(s) (in this example CCMs 28*a*, 28*b*), which interpret these signals and send commands to the trim tabs 40 (as shown in FIG. 4A), trim actuators 48*a* and 48*b*, and steering actuators 50*a* and 50*b*. In the example shown, the CCMs are illustrated as separate modules controlling separate functions; however, it should be understood that any of the control sections shown and described herein could be provided in fewer modules or more modules than those shown.

Each of the controllers 28*a*, 28*b*, 30*a*, 30*b*, etc. may have a memory and a programmable processor, such as processor 37 and memory 33 shown for CCM 28*a*. As is conventional, the processor 37 can be communicatively connected to memory 33 (such as, for example, RAM or ROM) being a computer-readable medium upon which computer-readable code (software) is stored. The processor 37 can access the computer-readable code on the computer-readable medium, and upon executing the code can send signals to carry out functions according to the methods described herein. Execution of the code allows the control system 32 to control a series of actuators (for example steering actuators 50*a*, 50*b* and trim actuators 48*a*, 48*b*) associated with the steerable marine drives 12*a*, 12*b*. Processing can be implemented within a single processing device but can also be distributed across multiple processing devices or sub-systems that cooperate in executing program instructions. Examples include general-purpose central processing units, application-specific processors, and logic devices, as well as any other type of processing device, combinations of processing devices, and/or variations thereof. The control system 32 may also obtain data from sensors aboard the vessel (e.g., trim position sensors 35*a* and 35*b* and steering position sensors 55*a* and 55*b*, and the one or more of the controllers 28*a*, 28*b*, 30*a*, 30*b*, etc. in the control system 32 may save or interpret the sensed or measured data as described herein.

Figure 4B:
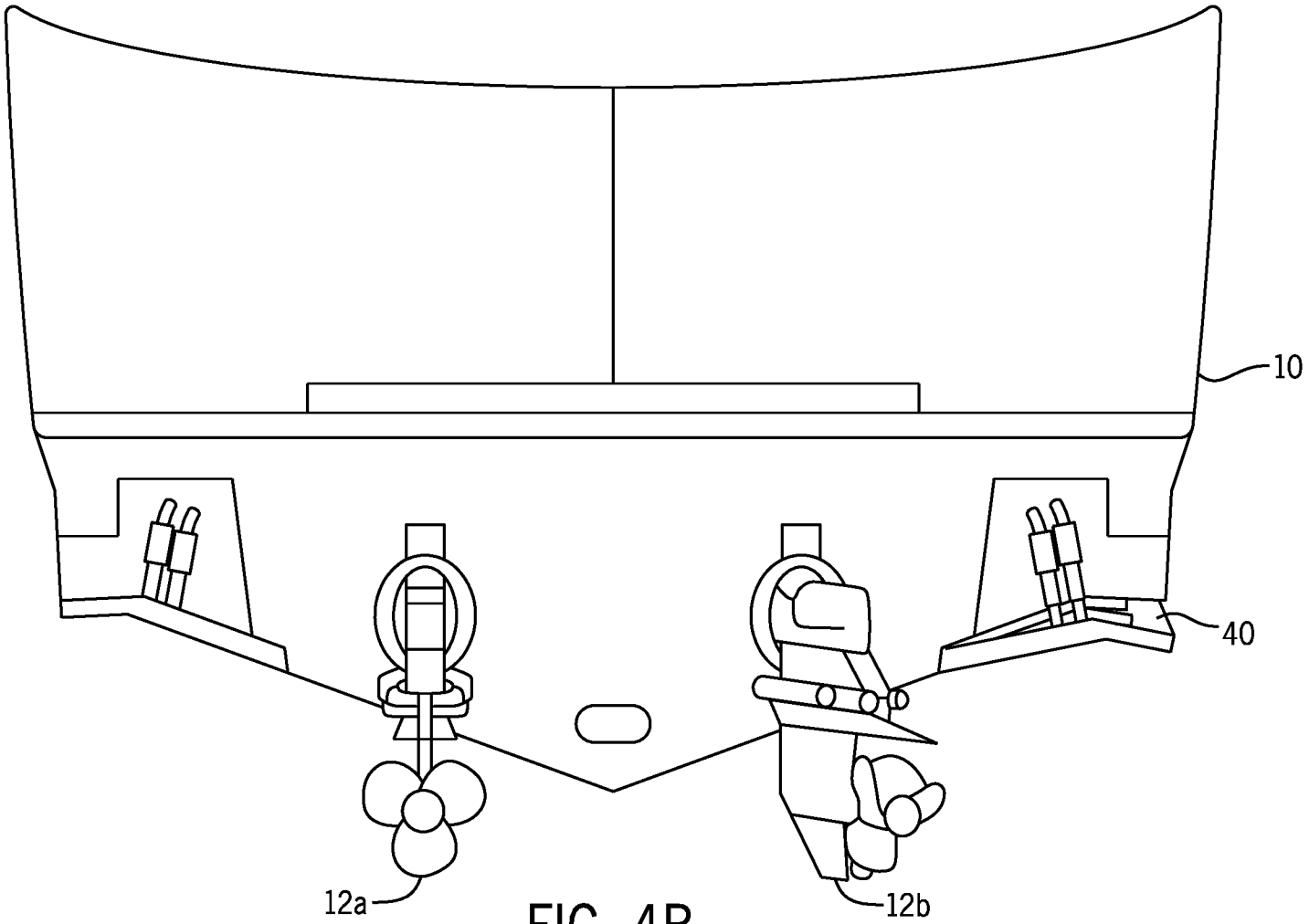

FIGS. 4A-4B depict an exemplary embodiment of a surf control system. The surf control system utilizes components common on a marine vessel 10, such as a steerable device 5, which may be a steerable marine drive 12*a*, 12*b* or a steerable rudder 60, a standard trim tab system, and/or trimmable propulsion devices, as non-limiting examples. In one embodiment, the surf control system may extend or retract trim tabs 40 to assist in creating a surfable wave.

Specifically, the surf system utilizes existing components on a marine vessel 10 to create a surfable wave without the need for surf products, surf-specific appendages, or ballasts. Each steerable device 5 has independent steering control, allowing for individual manipulation of the steering position 52 for each steerable device 5. The control system 32 ensures the steering angle of each steerable marine drive 12*a*, 12*b* is properly configured to create a surfable wave. Control systems that may direct the steering position 52 of the steerable marine drives 12*a*, 12*b* may allow for input from the user, such as on a stern drive boat that has joystick controls, as a non-limiting example. In another embodiment, the control system 32 may provide automated control based on a predetermined setting selected from the helm 24 of the marine vessel 10, such as a surf mode, wherein the control system 32 adjusts the steering position 52 of the marine drives 12*a*, 12*b* to form a surfable wave. On marine vessels that use trim tabs 40, like those shown in FIGS. 4A-4B, the trim tabs 40 may also be extended to predetermined lengths to create the surfable wave. This same method of surfable wave formation works for other types of steerable devices 5 including, but not limited to, outboard drives, stern drives, forward-facing stern drives, and shaft-driven marine vessels 10.

The formation of the surfable wave is the result of at least two steerable devices 5 performing different operative tasks. In one embodiment, the two steerable marine drives 12*a*, 12*b* may form a surfable wave as the first marine drive (here, drive 12*b*) operates at a fixed steering angle and the second marine drive (here, 12*a*) provides steering and thrust to the marine vessel 10. In one embodiment, the first marine drive 12*b* operates passively in that it does not produce any thrust, or produces minimal thrust output. Alternatively, due to the drag created by the angle of the steering position of the first marine drive 12*b*, the first marine drive 12*b* may be operated to provide thrust to maintain sufficient surf speeds. In such an embodiment, the steering angle of the wave-producing drive may be adjusted to account for the generated thrust and the thrust balancing capacity of the second drive (e.g., due to steering restrictions). In another embodiment, the steerable marine drives 12*a*, 12*b* operate in conjunction with trim tabs 40. Roll and yaw moments required to create the surfable wave are introduced by the operation of the first marine drive 12*b* and the deployment of the trim tabs 40.

Figure 5:
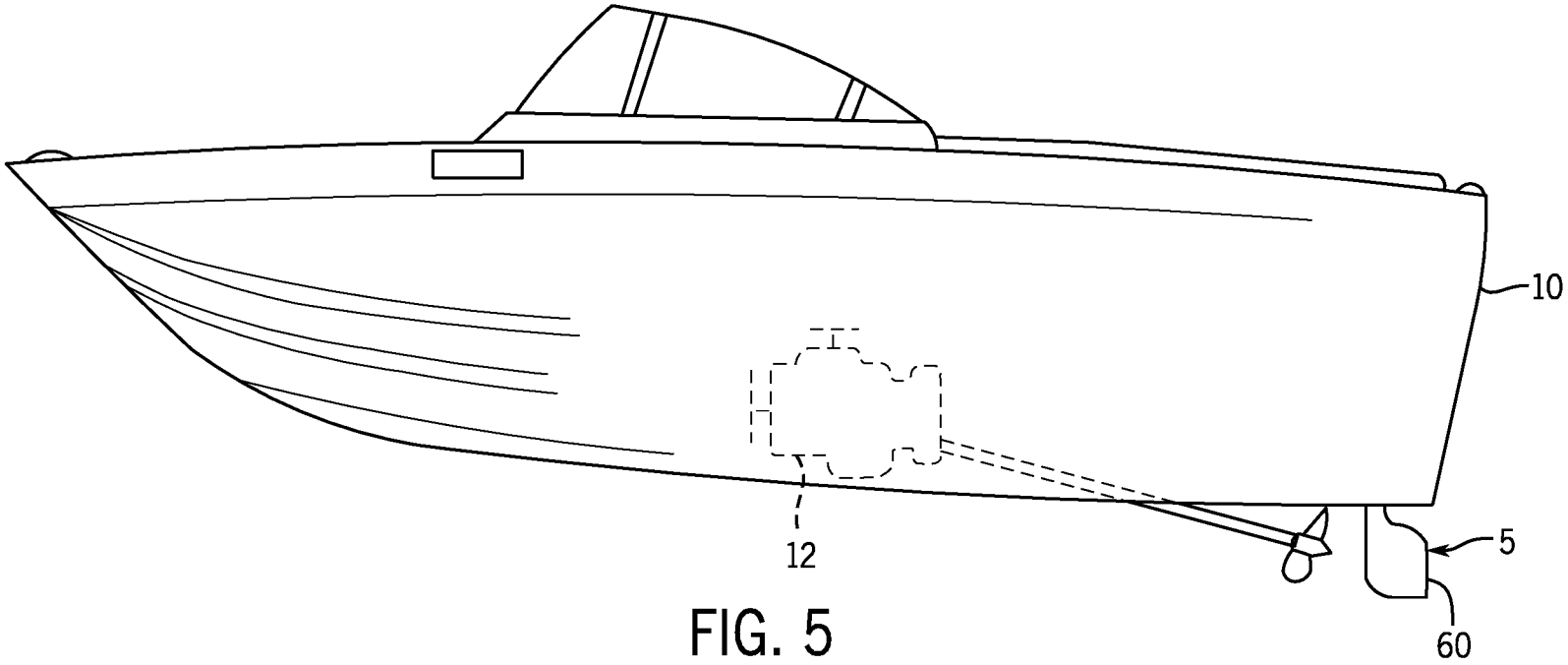

FIG. 5 depicts an alternative embodiment of a surf control system utilizing a steerable rudder 60, such as one of a pair of steerable rudders 60 (shown in a side profile where only a closest one is visible) associated one or a pair of fixed thrust inboard drives 12, as a wave generating steerable device 5. Inasmuch as the surf control system may utilize the existing components on a plurality of marine vessel 10 models and configurations, the physical design of the marine vessel may affect the steering position of the steerable device 5, including the location, size, and orientation of each steerable rudder. For example, the fluid dynamics of the flow of the water around the marine vessel 10 are determined, at least in part, by the shape of the hull of the marine vessel 10 and the location of the wave-generating rudder with respect to the vessel hull, which can be steered to a wave generating position similar to the wave-generating steerable drive 12*b* shown in FIG. 4B. The shape of the hull and location of the rudder being used for wave generation then contributes to the determination of the steering position 52 of a steerable rudder 60 fixed at the optimal angle to create a surfable wave.

Systems utilizing one or more rudders may include one or more trim tabs to adjust the size and length of the surfable wave by adjusting vessel pitch and/or roll. Alternatively or additionally, systems may include one or more trimmable marine drives. The amount of water displaced by the configuration of the marine vessel 10 largely contributes to the shape of the surfable wave. As an example, the running attitude of the marine vessel 10 and the length of the extended trim tab 40 can adjust the size and location of the surfable wave. For example, if the pitch of the marine vessel 10 is reduced (the vessel is more parallel with the water surface), the surfable wave becomes longer and smaller. An increase in pitch yields opposite results, where if the bow of the vessel is raised and the stern is dropped, the wave becomes larger and more concentrated. On marine vessels that use a drive trim, the trim position allows the marine vessel 10 to use thrust vectoring in the formation of the surfable wave. By increasing the drive trim position or one or both of the drives 12*a*, 12*b*, the transom is forced deeper into the water. This, in turn, impacts the running attitude of the marine vessel; the adjustment alters the pitch equilibrium by raising the bow and lowering the stern. Additionally, as the speed of the marine vessel increases, the length of the surfable wave increases and the height of the surfable wave decreases.

In one embodiment, the trim actuator for each marine drive 12 may differ. A configuration where one of the marine drives 12*a*, 12*b* is steered out to generate the wave is also trimmed out (e.g., to 10-30 degrees from a vertical trim position), a second one of the steerable marine drives 12*a*, 12*b* effectuating steering and propulsion may be trimmed in or out, as needed to most efficiently and effectively counteract the yaw moment generated by the first drive as well as to optimize the wave. For example, a difference in trim positions between drives 12*a*, 12*b* may be utilized to generate a roll moment, particularly where the propulsion system does not include trim tabs. In certain embodiments, the angle of the trim actuators 48, the steerable devices 5, and the trim tabs 40, or any combination thereof, may be determined autonomously as a commanded angle at a commanded speed, based on a predetermined performance selection routine, such as executed as part of a surf mode.

Figure 6:
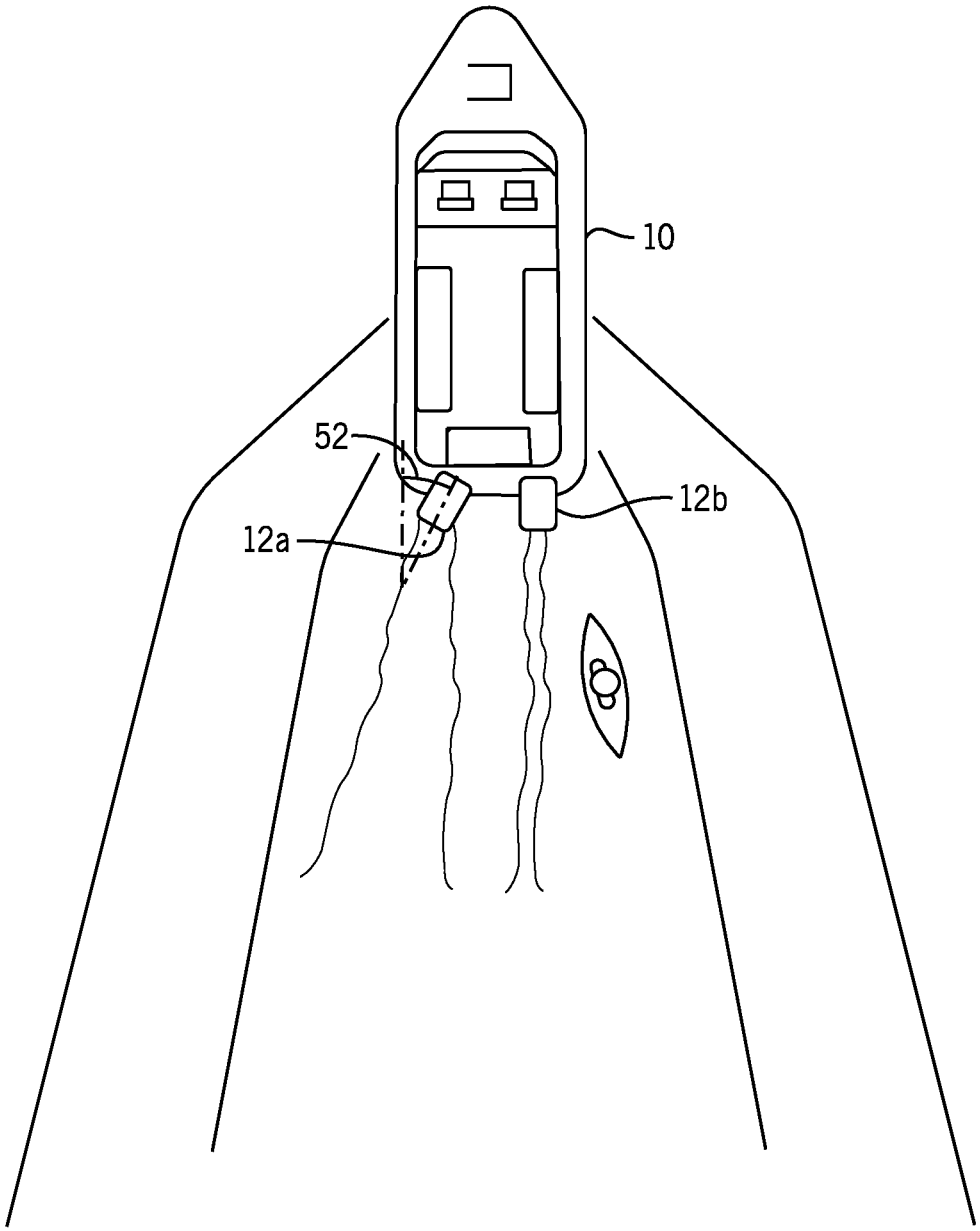
FIG. 6 depicts an exemplary surf control system operating to generate a surfable wave in accordance with the present disclosure.

FIG. 6 illustrates an example where two steerable marine drives are operated to create a wave on the starboard side of a vessel. The port-side marine drive 12*a* is steered to an outward angle 52, which creates a yaw moment. A port trim tab 40 (not shown here) may also be utilized, which would generate a roll moment. When applicable, the trim tab 40 located on the same side of the marine vessel 10 as the wave-generating steerable device 5 is deployed to a downward trim angle to create a relative lift compared to the other side of the vessel. The net effect generates a delta between the heading of the marine vessel 10 and the course direction. This creates an asymmetry in the way that the water converges behind the marine vessel 10. The asymmetry then carries all of the prop wash from the port marine drive 12*a* over the centerline thereby creating a surfable wave on the starboard side of the vessel. This configuration leaves the remaining steerable device 5 on the starboard side (here, marine drive 12*b*) to maintain the proper heading and thrust levels of the marine vessel 10.

Figure 7:
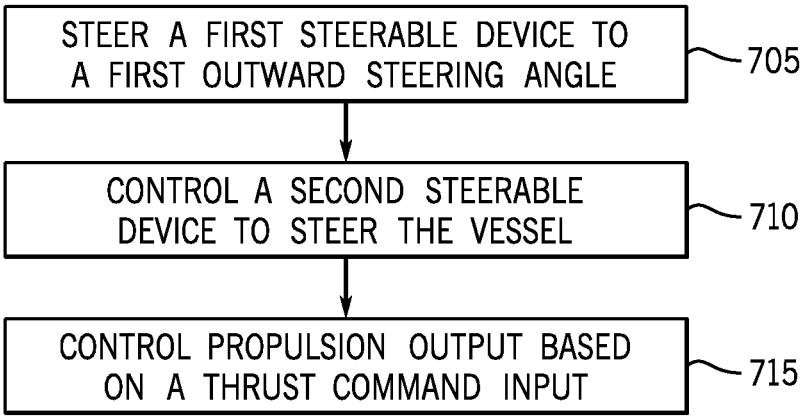
FIGS. 7, 8, and 9 outline exemplary method steps for a surf control system in accordance with the present disclosure.

Referring now to FIG. 7, exemplary method steps for surf control are illustrated. At 705, the surf control system steers a first steerable device to a first outward steering angle. The first steerable device remains fixed in the outward steering angle to create a sufficient yaw moment to form a surfable wave. At 710, the surf control system controls a second steerable device to counteract the yaw moment and also to control and adjust the heading of the vessel. At 715, the surf control system controls the propulsion output based on a thrust command input, which may be a steerable marine drive or may be a fixed drive. These inputs may be provided by the operator of the marine vessel via controls at the helm or one or more of the steering and propulsion commands may be part of a selected setting or mode, such as a surf mode, that is activated, as non-limiting examples.

Figure 8:
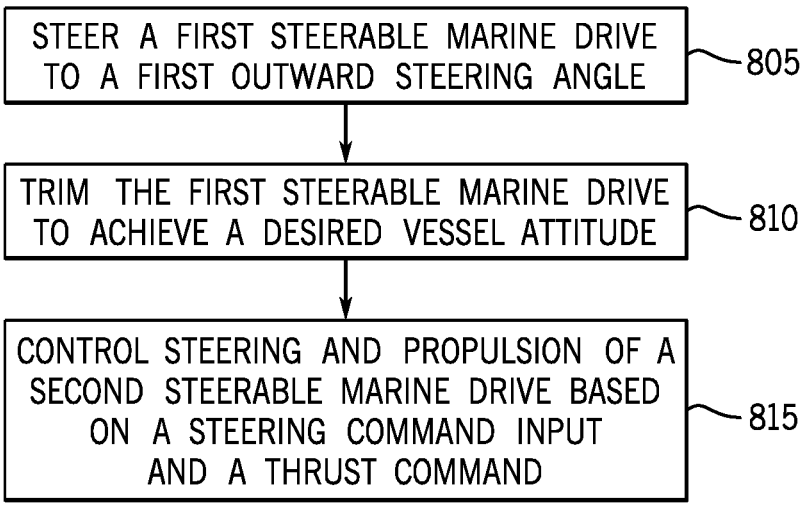

Referring now to FIG. 8, further exemplary method steps for surf control are illustrated. At 805, the surf control system steers a first steerable device to a first outward steering angle, which in this example is a steerable marine drive one either a port side or a starboard side of the vessel centerline. At 810, the first steerable marine drive is trimmed to achieve a desired vessel attitude and to adjust the size of the surfable wave. By increasing the drive trim position (trimming the drive up), for example, the transom is forced deeper into the water. This, in turn, affects the running attitude of the marine vessel and the adjustment alters the pitch equilibrium by raising the bow and lowering the stern. At 815, the surf control system controls a second steerable marine drive for controlling the heading and the thrust of the marine vessel.

Figure 9:
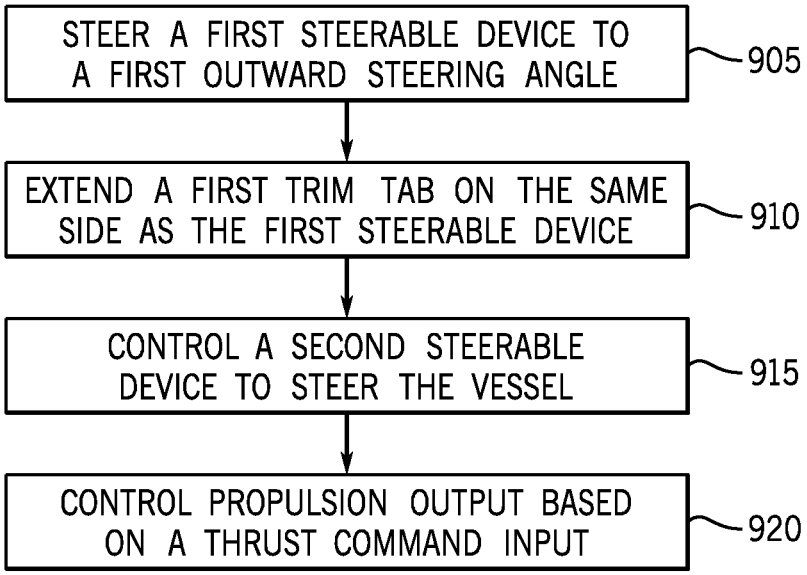

Referring now to FIG. 9, further exemplary method steps for surf control are illustrated. At 905, the surf control system steers a first steerable device to a first outward steering angle. At 910, a first trim tab is extended on the same side of the marine vessel as the first steerable device. The net effect of the yaw moment generated by the first steerable device and the roll moment created by the first trim generates a delta between the heading of the marine vessel 10 and the course direction, thereby creating an asymmetric surfable wave on the opposite side behind the marine vessel 10 as described above. At 915, the surf control system controls the second steerable device to counteract the yaw moment and controlling the heading of the marine vessel. At 920, the surf control system controls the propulsion output (such as of a fixed or steerable drive as described in various embodiments above) based on a thrust command input. The steering command input and the thrust command input may be submitted by the user via a user input device located at the helm of the marine vessel (e.g., a joystick or a steering wheel and throttle lever). Alternatively, propulsion may be controlled by the control system executing a surf control or other launch or tow sports propulsion control routine. In still other embodiments, both propulsion and steering may be automatically controlled, such as by an autonomous control system utilizing proximity sensors and/or image processing to steer the vessel.

A number of embodiments of the present disclosure have been described. While this specification contains many specific implementation details, these should not be construed as limitations on the scope of any disclosure or of what may be claimed, but rather as descriptions of features specific to particular embodiments of the present disclosure.

Certain features that are described in this specification in the context of separate embodiments can also be implemented in combination or in a single embodiment. Conversely, various features that are described in the context of a single embodiment can also be implemented in combination in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous.

Moreover, the separation of various system components in the embodiments described above should not be understood as requiring such separation in all embodiments, and it should be understood that the described components and systems can generally be integrated together in a single product or packaged into multiple products.

Thus, particular embodiments of the subject matter have been described. Other embodiments are within the scope of the following claims.

What is claimed is:

1. A method of controlling at least two steerable devices on a marine vessel for generating an asymmetric surfable wave behind the marine vessel, the method comprising:

steering a first steerable device on a first side of the marine vessel to a first steering angle to generate the asymmetric surfable wave behind the marine vessel; and controlling a second steerable device on a second side of the marine vessel based on a steering command input.

2. The method of claim 1, further comprising controlling propulsion output by a marine drive on the second side of the marine vessel based on a thrust command input.

3. The method of claim 1, wherein the first steering angle is not adjusted in response to the steering command input.

4. The method of claim 1, wherein the first steerable device is a first steerable rudder and the second steerable device is a second steerable rudder.

5. The method of claim 1, wherein the first steerable device is a first steerable marine drive on the first side of the marine vessel and the second steerable device is a second steerable marine drive on the second side of the marine vessel.

6. The method of claim 5, wherein a steering position of the second steerable marine drive is controlled based on the steering command input and a thrust output of the second steerable marine drive is controlled based on a thrust command input.

7. A method of controlling a propulsion system on a marine vessel with at least two steerable devices for generating an asymmetric surfable wave behind the marine vessel, the method comprising:

steering a first steerable device on a first side of the marine vessel to a first steering angle to generate the asymmetric surfable wave behind the marine vessel;

controlling a second steerable device on a second side of the marine vessel based on a steering command input; and controlling propulsion output on the second side of the marine vessel based on a thrust command input.

8. The method of claim 7, wherein the first steering angle is an outward steering angle and is not adjusted in response to the steering command input.

9. The method of claim 7, wherein the first steering angle is a fixed steering angle not adjusted in response to the steering command input.

10. The method of claim 7, comprising at least three steerable devices, wherein at least two steerable devices of the at least three steerable devices are steered to outward steering angles to generate the asymmetric surfable wave.

11. The method of claim 7, wherein the first steerable device is a first steerable marine drive and the second steerable device is a second steerable marine drive;

wherein a steering position of the second steerable marine drive is controlled based on the steering command input and a thrust output of the second steerable marine drive is controlled based on the thrust command input.

12. The method of claim 11, further comprising controlling a trim position of the first steerable marine drive in coordination with the first steering angle to control a size and shape of the asymmetric surfable wave.

13. The method of claim 7, further comprising controlling at least a first trim tab on the first side of the marine vessel in coordination with the first steering angle to control a size and shape of the asymmetric surfable wave.

14. The method of claim 13, wherein the first steerable device is a first steerable marine drive, and further comprising controlling a trim position of the first steerable marine drive and at least the first trim tab on the first side of the marine vessel in coordination with the first steering angle to control the size and shape of the asymmetric surfable wave.

15. The method of claim 7, wherein the first steerable device is a first steerable rudder and the second steerable device is a second steerable rudder.

16. The method of claim 15, wherein the first steerable rudder remains at a first steering angle to generate the asymmetric surfable wave and is not adjusted in response to the steering command input, and further comprising adjusting a thrust output of a marine drive positioned on the second side of the marine vessel in response to the thrust command input.

17. The method of claim 15, further comprising controlling at least a first trim tab on the first side of the marine vessel in coordination with the first steering angle of the first steerable device to control a size and shape of the asymmetric surfable wave.

18. The method of claim 7, wherein the steering command input and/or the thrust command input are based on user inputs via at least one user input device.

19. The method of claim 7, wherein the thrust command input is automatically generated by a controller based on a user-selected mode, and wherein the first steering angle is predetermined by the user-selected mode.

20. A marine propulsion system for generating an asymmetric surfable wave behind a marine vessel, the system comprising:

at least two steerable devices, including at least a first steerable device and a second steerable device;

a control system configured to:

steer the first steerable device to a first steering angle to generate the asymmetric surfable wave behind the marine vessel;

control the second steerable device based on a steering command input to steer the marine vessel; and control propulsion output based on a thrust command input.

21. The system of claim 20, wherein the first steerable device on a first side of the marine vessel and the second steerable device is on a second side of the marine vessel, wherein the first steering angle is an outward steering angle and the asymmetric surfable wave is angled toward the second side of the marine vessel.

22. The system of claim 20, wherein the first steering angle is not adjusted in response to the steering command input.

23. The system of claim 20, wherein the first steerable device is a first steerable marine drive on a first side of the marine vessel and the second steerable device is a second steerable marine drive on a second side of the marine vessel; and wherein a steering position of the second steerable marine drive is controlled based on the steering command input and a thrust output of the second steerable marine drive is controlled based on the thrust command input.

24. The system of claim 23, wherein the control system is further configured to control a trim position of the first steerable marine drive in coordination with the first steering angle to control a size and shape of the asymmetric surfable wave.

25. The system of claim 20, wherein the first steerable device is on a first side of the marine vessel and the second steerable device is on a second side of the marine vessel, and wherein the control system is further configured to control at least a first trim tab on the first side of the marine vessel in coordination with the first steering angle to control a size and shape of the asymmetric surfable wave.

26. The system of claim 20, wherein the first steerable device is a first steerable rudder.

27. The system of claim 26, wherein the control system is further configured to adjust only the second steerable device in response to the steering command input, wherein the first steerable rudder is not adjusted in response to the steering command input.

* * * * *